US009268291B2

(12) United States Patent
Okamoto et al.

(10) Patent No.: US 9,268,291 B2
(45) Date of Patent: Feb. 23, 2016

(54) IMAGE FORMING APPARATUS HAVING CIRCUIT BOARD

(71) Applicant: Brother Kogyo Kabushiki Kaisha, Nagoya (JP)

(72) Inventors: Yoshihiro Okamoto, Komaki (JP); Masahito Saeki, Nagoya (JP); Shougo Sato, Seto (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/636,584

(22) Filed: Mar. 3, 2015

(65) Prior Publication Data

US 2015/0277340 A1 Oct. 1, 2015

(30) Foreign Application Priority Data

Mar. 28, 2014 (JP) ..... 2014-069734

(51) Int. Cl.
*G03G 15/00* (2006.01)
*G03G 21/16* (2006.01)

(52) U.S. Cl.
CPC ..... *G03G 15/80* (2013.01); *G03G 21/1652* (2013.01)

(58) Field of Classification Search
CPC ... G03G 15/80; G03G 21/1652; G03G 21/16; G03G 2221/166; G03G 2221/1678; G03G 21/1666
USPC ..... 399/88, 90, 107
See application file for complete search history.

(56) References Cited

U.S. PATENT DOCUMENTS

| | | | | |
|---|---|---|---|---|
| 4,912,563 | A * | 3/1990 | Narita | G03G 21/1652 358/401 |
| 6,975,814 | B2 * | 12/2005 | Tsusaka et al. | 399/6 |
| 2004/0096229 | A1 * | 5/2004 | Yoshihara | H05K 7/20145 399/33 |
| 2004/0131378 | A1 * | 7/2004 | Hattori | G03G 15/80 399/90 |
| 2006/0034633 | A1 | 2/2006 | Tsusaka et al. | |
| 2010/0278556 | A1 * | 11/2010 | Saito et al. | 399/121 |

FOREIGN PATENT DOCUMENTS

| | | | |
|---|---|---|---|
| JP | H04-102111 | A | 4/1992 |
| JP | H06-127023 | A | 5/1994 |
| JP | 2002-268309 | A | 9/2002 |
| JP | 2006-053254 | A | 2/2006 |
| JP | 2008-145518 | A | 6/2008 |

* cited by examiner

*Primary Examiner* — Francis Gray
(74) *Attorney, Agent, or Firm* — Burr & Brown, PLLC

(57) ABSTRACT

An image forming apparatus includes an image forming unit, a pair of frames, a connecting member, a supply board, and a control board. The image forming unit includes a photosensitive body configured to carry developer and an exposure unit configured to scan and expose the photosensitive body to light. The pair of frames is disposed in a horizontal direction opposite to each other with the image forming unit being positioned therebetween. The connecting member extends in the horizontal direction and supports the exposure unit. The connecting member has each longitudinal end portion connected to each of the pair of frames. The supply board is configured to supply electric power to an electric motor. The control board is configured to control operation of the image forming unit. At least one of the control board and the supply board is supported to the connecting member.

17 Claims, 8 Drawing Sheets

IMAGE FORMING APPARATUS HAVING CIRCUIT BOARD

CROSS REFERENCE TO RELATED APPLICATION

This application claims priority from Japanese Patent Application No. 2014-069734 filed Mar. 28, 2014. The entire content of the priority application is incorporated herein by reference.

TECHNICAL FIELD

The present disclosure relates to an electro-photographic type image forming apparatus for forming an image onto a sheet.

BACKGROUND

Among the various conventional image forming apparatuses known in the art, one technology discloses an image forming apparatus in which a control board and a power supply board are assembled to one of a pair of frames between which an image forming section is provided as viewed in a vertical direction.

SUMMARY

When the control board and power supply board are assembled to the identical frame in a juxtaposed manner in a vertical direction, a dimension of the image forming apparatus in the vertical direction is inevitably increased.

At least some aspects of the present disclosure provide an image forming apparatus capable of reducing the vertical dimension.

According to at least one aspect of the disclosure, the present disclosure provides an image forming apparatus includes an image forming unit, a pair of frames, a connecting member, a supply board, and a control board. The image forming unit may include a photosensitive body configured to carry developer and an exposure unit configured to scan and expose the photosensitive body to light. The pair of frames may be disposed in a horizontal direction opposite to each other with the image forming unit being positioned therebetween. The connecting member may extend in the horizontal direction and supports the exposure unit. The connecting member may have each longitudinal end portion connected to each of the pair of frames. The supply board may be configured to supply electric power to an electric motor. The control board may be configured to control operation of the image forming unit. At least one of the control board and the supply board may be supported to the connecting member.

DETAILED DESCRIPTION

Figure 1:
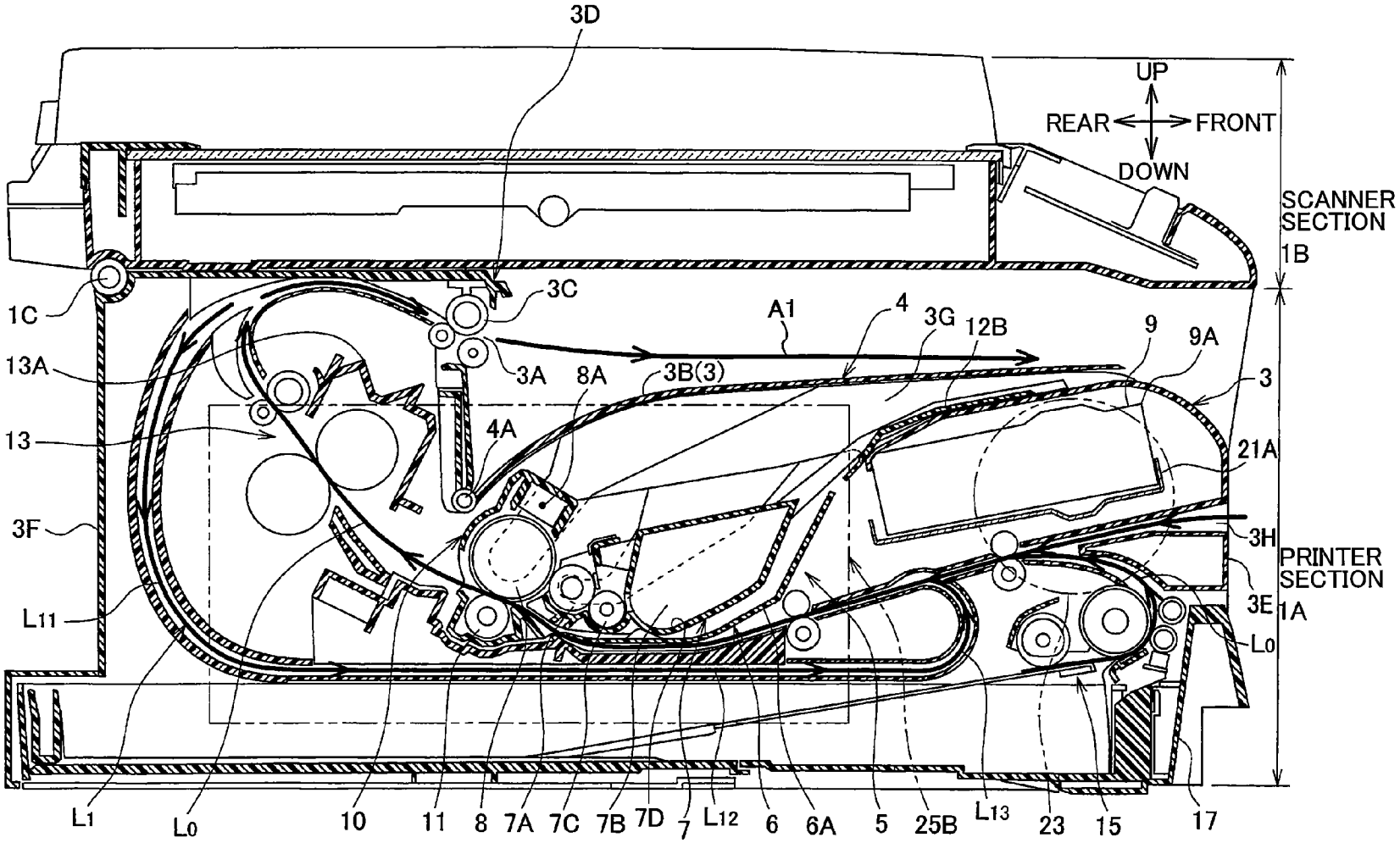
FIG. 1 is a central cross-sectional view of an image forming apparatus according to a first embodiment.

An image forming apparatus will be described in detail with reference to embodiments shown below. The embodiments merely indicate examples of the disclosure. Therefore, matters described in the claims are not limited to structure or means shown in the embodiments.

An image forming apparatus according to the embodiments of the present disclosure will be described while referring to the accompanying drawings wherein like parts and components are designated by the same reference numerals to avoid duplicating description. Incidentally, arrows and directions in the figures are indicated in order to help comprehension, and thus the present embodiments are not limited to these arrows and directions illustrated in the figures. Members, devices or portions with numeral numbers are provided at least one, except those with limitations such as "plural" or "not less than two" and the like.

In the embodiments, the present embodiments are applied to a monochromatic image forming apparatus.

(First Embodiment)

1. General Structure of Image Forming Apparatus

The image forming apparatus 1 according to a first embodiment is an integral apparatus including a printer section 1A and a scanner section 1B, as shown in FIG. 1. The printer section 1A is a printing device configured to form an image on sheets, such as sheets of paper. The scanner section 1B is an image reading unit configured to read images (including letters) on an original.

The scanner section 1B is disposed vertically upward of the printer section 1A. Below the scanner section 1B, a sheet discharge tray 3B is provided to accommodate printed sheets.

The scanner section 1B is connected to the printer section 1A through a hinge portion 1C, and is pivotable about the hinge portion 1C. The hinge portion 1C is provided at an upper and rear side of the printer section 1A.

Incidentally, the rear side of the printer section 1A is the opposition side of the front side, which is defined by a sheet discharging direction A1; sheets are disposed frontward to the sheet discharge tray 3B. For example, the right side of FIG. 1 indicates the front side of the printer section 1A, and the left side of FIG. 1 indicates the rear side of the printer section 1A.

2. Configuration of Printer Portion

The printer section 1A includes a housing 3 and an image forming unit 5, which is configured to form images on sheets, is provided in the housing 3. The housing 3 includes a sheet discharge tray 3B and forms a discharge opening 3A at an upper portion of the housing 3. The discharge opening 3A is a portion from which sheets with formed images thereon are disposed.

The sheet discharge tray 3B receives sheets disposed from the discharge opening 3A thereon. A discharge roller 3C configured to convey sheets to the sheet discharge tray 3B is provided at the discharge opening 3A. The discharge roller 3C has selectable two sheet conveying methods as follows: one method is to convey sheets to the sheet discharge tray 3B, and the other method is to reconvey sheets to the image forming unit 5 by reversing the sheet conveying direction.

The housing 3 includes a top cover 3D, one pair of side covers (not shown), a front cover 3E, and a rear cover 3F. The top cover 3D covers an upper surface in the vertical direction of the printer section 1A. The side covers respectively cover a left surface and a right surface of the printer section 1A, and serve as part of the exterior design of the printer section 1A.

The front cover 3E covers a front surface of the printer section 1A to form the exterior design of the printer section 1A. The rear cover 3F covers a rear surface of the printer section 1A to serve as part of the exterior design of the printer section 1A.

The front cover 3E includes a manual feed slot 3H. The manual feed slot 3H is an opening portion to directly supply sheets to the image forming unit 5 without employing a feeder mechanism 15, described later. Specifically, when a user inserts a sheet into the manual feed slot 3H, the image forming unit 5 forms images on the inserted sheet.

An opening 3G is formed at a portion of the top cover 3D corresponding to the sheet discharge tray 3B. The opening 3G has an upper open end in the vertical direction. The opening 3G can be closed by a movable cover 4. The movable cover 4 is movable between a closing position to close the opening 3G and an opening position to open the opening 3G.

The movable cover 4 is connected to the top cover 3D through a hinge portion 4A so that one end portion of the movable cover 4 is pivotable about another end portion of the movable cover 4. An upper surface of the movable cover 4 constitutes at least a part of the sheet discharge tray 3B on which sheets are placed.

The image forming unit 5 is a unit employing an electrophotographic method, in which developer is transferred onto sheets. The image forming unit 5 includes a process unit 6, an exposure unit 9, a transfer unit 11, and a fixing unit 13. The process unit 6 is detachable to the frame body of the apparatus via the opening 3G.

Figure 2:
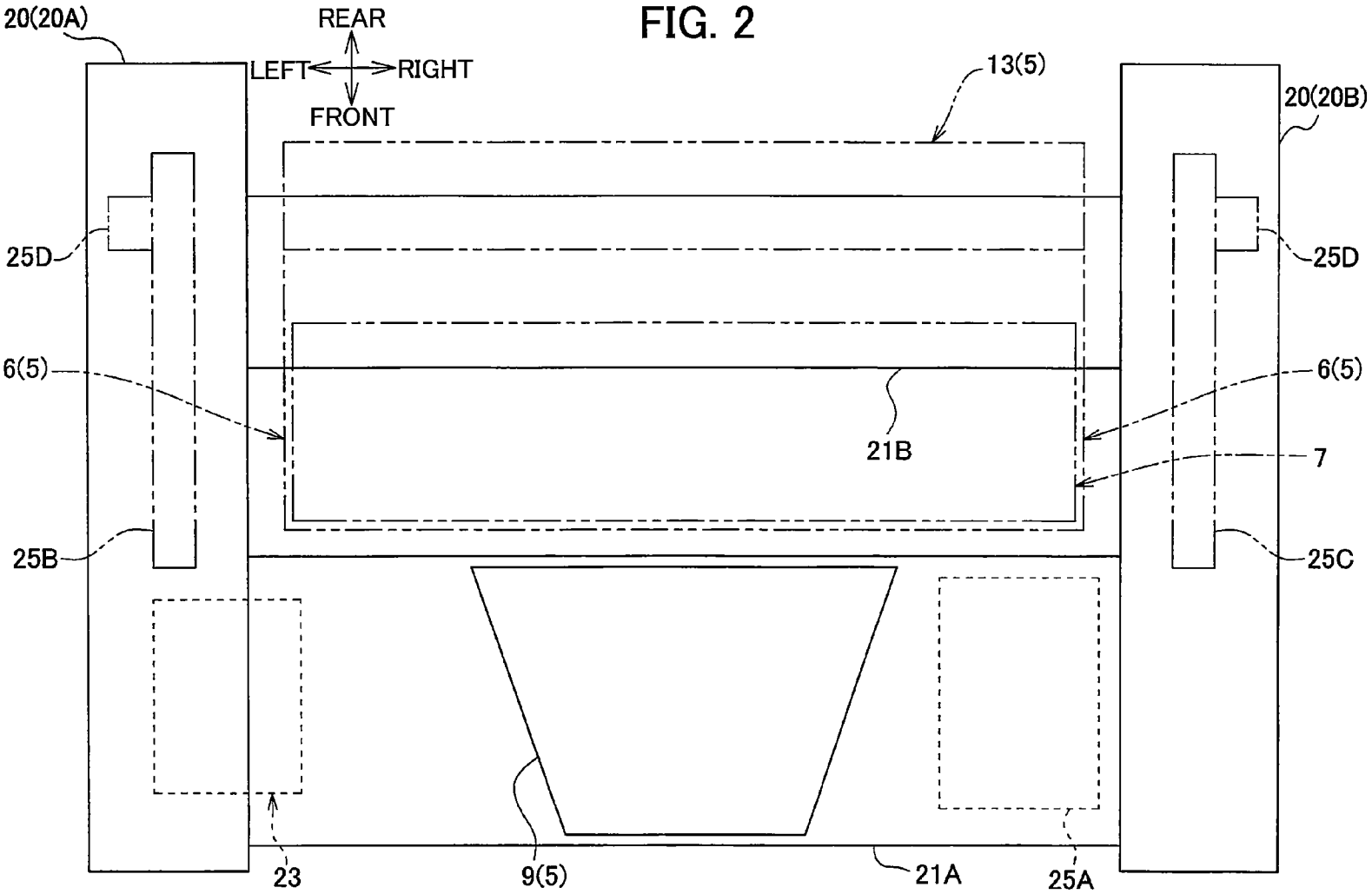
FIG. 2 shows an imaginary horizontal plane, on which a pair of frames, an image forming unit, a first connecting member, and other members in the image forming apparatus are projected.

The frame body referred to herein implies a disassembleable part, such as the housing 3 or a frame 20 (see FIG. 2). The pair of frames 20 is provided on both lateral sides such that the image forming unit 5 is positioned between the frames 20 in the horizontal direction. Each frame 20 is a substantially plate-like member formed of a resin or a metal having high mechanical strength.

The process unit 6 is an integral unit including a developer cartridge 7 and a drum cartridge 10. The process unit 6 includes a support member 6A, and the developer cartridge 7 and the drum cartridge 10 are integrated by the support member 6A. The developer cartridge 7 is detachably disposed in the support member 6A. The drum cartridge 10 is undetachable to the support member 6A, and is integrally provided in the support member 6A.

The developer cartridge 7 includes a developing roller 7A, a supply roller 7C, and a developer chamber 7B. The developer chamber 7B accommodates developer, which is supplied to a photosensitive drum 8, which is an example of a photosensitive body. The developing roller 7A and the supply roller 7C supply the photosensitive drum 8 with the developer accommodated in the developer chamber 7B.

The drum cartridge 10 includes the photosensitive drum 8 and a charger 8A. Specifically, the process unit 6 includes the photosensitive drum 8, the charger 8A, the developing roller 7A, the supply roller 7C, and the developer chamber 7B.

The photosensitive drum 8 is a photosensitive body carrying a developer image thereon. The charger 8A charges the photosensitive drum 8. The charged photosensitive drum 8 is then exposed to a laser beam emitted from the exposure unit 9. As a result of the exposure to the laser, the photosensitive drum 8 has an electrostatic latent image thereon.

The exposure unit 9 is so-called a "scanner type" exposure unit that exposes the photosensitive drum 8 to scanning laser beam by rotating a polygon mirror (not shown) with an electric motor (not shown).

A developer image is formed on the photosensitive drum 8 by supplying developer to the photosensitive drum 8 on which an electrostatic latent image has been formed. A transfer unit 11 is provided at a position facing the photosensitive drum 8. The transfer unit 11 is configured to transfer the developer image carried on the photosensitive drum 8 onto the sheet.

The fixing unit 13 directly or indirectly heats the developer transferred onto the sheet, and fixes the developer image on the sheet. A feeder mechanism 15 is provided upstream of the image forming unit 5 in the sheet conveying direction.

The feeder mechanism 15 feeds sheets accommodated in the sheet supply tray 17 to the image forming unit 5 one by one. The sheet supply tray 17 is detachably installed vertically downward of the process unit 6 in the frame body.

As shown in FIG. 2, the pair of frames 20 are connected to each other by a first connecting member 21A and a second connecting member 21B. The first connecting member 21A and the second connecting member 21B are each a strip-shaped member that extends in the horizontal direction so as to be bridged between the pair of frames 20. Each end of each of the first and second connecting members 21A and 21B is connected to each of the frames 20.

The first connecting member 21A is positioned forward of the second connecting member 21B and constitutes a holding plate for holding the exposure unit 9. The second connecting member 21B is positioned lower than the first connecting member 21A in the vertical direction and is connected to a lower end portion of each frame 20. The first and second connecting members 21A and 21B are each formed of a metal plate such as SPCC (cold-reduced carbon steel sheets) or SECC (electrolytic zinc-coated steel sheets).

According to the embodiment as shown in FIG. 1, the exposure unit 9 and the process unit 6, in that order, are arranged from the front side, and are disposed vertically downward of the movable cover 4, which composes the sheet discharge tray 3B. Specifically, the exposure unit 9, the developer chamber 7B, the supply roller 7C, the developing roller 7A, the photosensitive drum 8, and the fixing unit 13, in that order, are arranged from the front side.

When viewing an imaginary vertical plane extending in a sheet discharging direction as indicated by an arrow A1 shown in FIG. 1, a sheet conveying path Lo extending from the sheet supply tray 17 to the sheet discharge tray 3B assumes an S-shape having a first bent portion at a portion below the exposure unit 9 and a second bent at a portion downstream of the photosensitive drum 8 in the sheet conveying direction.

A re-conveying path L1 is provided for re-conveying the sheet whose one surface has been formed with an image to the image forming unit 5. The re-conveying path L1 has a portion below the exposure unit 9. That is, the sheet whose conveying direction is reversed by the discharge roller 3C is re-conveyed to the image forming unit 5 along the re-conveying path L1. The re-conveying path L1 is constituted by a first portion L11, a second portion L12, and a third portion L13.

The first portion L11 extends vertically and is positioned rearward of the fixing unit 13 and reaches a portion below the process unit 6. The second portion L12 extends forward from the portion below the process unit 6 and reaches a portion below the exposure unit 9. The third portion L13 extends upward from the second portion L12 and then extends rearward toward the image forming unit 5.

3. Arrangement of Electric Devices

As shown in FIG. 2, the printer section 1A includes an electric motor 23, a control board 25A, a high-voltage power supply board 25B, and a low-voltage power supply board 25C. The electric motor 23 is adapted to supply a rotation force to the image forming unit 5 and the feeder mechanism 15.

The control board 25A is adapted to control operation of the image forming unit 5 and the electric motor 23. The high-voltage power supply board 25B is adapted to supply power to a device that requires a high driving voltage such as the charger 8A. The low-voltage power supply board 25C supplies power to a device that requires a drive voltage lower than that of the charger 8A such as the electric motor 23. An electric component such as an electrolytic capacitor 25D having a size larger than that of a transistor is surface-mounted on the high-voltage power supply board 25B or the low-voltage power supply board 25C.

The electric motor 23 and the high-voltage power supply board 25B are assembled to an identical frame 20A (left side frame of the pair of frames 20 in this embodiment). On the other hand, the low-voltage power supply board 25C is assembled to another frame 20B (right side frame of the pair of frames 20).

The high-voltage power supply board 25B and the low-voltage power supply board 25C are each assembled to the frames 20A and 20B, respectively, such that each board surface is fixed to a plate face of the frame 20A or 20B in parallel using a mechanical fastener (not shown) such as a screw.

The electric motor 23 is assembled to the frame 20A such that an output shaft (not shown) of the motor extends perpendicular to the plate face of the frame 20A. A power transmission mechanism (not shown) is provided on the frame 20A for transmitting a driving force generated by the electric motor 23 to the photosensitive drum 8 and the feeder mechanism 15.

As shown in FIG. 1, a part of the electric motor 23 and the exposure unit 9 are superposed with each other in an imaginary projection plane perpendicular to the output shaft of the electric motor 23.

The control board 25A is held directly to the first connecting member 21A. The expression "held directly" implies that the control board 25A is assembled to the first connecting member 21A through an electrically insulative spacer made from resin.

The control board 25A can be held indirectly to the first connecting member 21A. Here, the expression "held indirectly" implies that the control board 25A is assembled directly or indirectly to another component (such as the exposure unit 9) assembled to the first connecting member 21A.

As shown in FIGS. 1 and 2, when viewing in an imaginary horizontal plane and an imaginary vertical plane, the control board 25A is displaced from the exposure unit 9. More specifically, the control board 25A, the developer chamber 7B (the process unit 6), and the fixing unit 13 are disposed away from each other in the imaginary horizontal plane.

As shown in FIG. 1, when viewing in an imaginary vertical plane perpendicular to the extending direction of the first connecting member 21A, the developer chamber 7B is positioned lower than an upper end 9A of the exposure unit 9 and an upper end 13A of the fixing unit 13.

Further, when viewing the an imaginary vertical plane, a lower end 7D of the developer chamber 7B is positioned lower than the exposure unit 9, the fixing unit 13, the first connecting member 21A, and the board (the control board 25A) held by the first connecting member 21A.

The control board 25A is positioned opposite to the electric motor 23 with respect to the exposure unit 9. That is, the control board 25A and the electric motor 23 are provided at one end portion and another end portion of the first connecting member 21A in the extending direction thereof, respectively.

4. Features According to Present Embodiment

In the present embodiment, the control board 25A is held by the first connecting member 21A. Therefore, a vertical dimension of the image forming apparatus 1 can be reduced in comparison with a case where the control board 25A is held by the frame 20.

That is, if the control board 25A and one of the high-voltage power supply board 25B and the low-voltage power supply board 25C are assembled to the identical frame 20, the vertical dimension of the frame 20 inevitably assumes a value obtained by adding the vertical dimensions of the control board 25A and one of the power supply boards, 25B and 25C.

On the other hand, in the present embodiment, the control board 25A is held by the first connecting member 21A. Thus, frame 20 can have the vertical dimension capable of containing the larger one of the high-voltage power supply board 25B and the low-voltage power supply board 25C in the vertical dimension. Thus, the vertical dimension of the image forming apparatus 1 can be reduced.

The control board 25A according to the present embodiment is held by the first connecting member 21A to which the exposure unit 9 is also assembled. Therefore, a length of wiring (not shown) connecting the control board 25A to the exposure unit 9 can be reduced in comparison with a case where the control board 25A is held by the frame 20.

This structure can prevent the wiring from being significantly influenced by electrical noise. Therefore, disturbance of a waveform of a control signal can be restrained even in a case of high operation speed of the exposure unit 9.

Incidentally, amount of heat generation from the fixing unit 13, the electric motor for the exposure unit 9 and the control board 25A are greater than that from other components. Thus, degradation of the developer may occur at an early stage when the developer in the developer chamber 7B is heated by air heated by the fixing unit 13 and the exposure unit 9.

The first connecting member 21A itself does not generate heat. However, the first connecting member 21A is formed of a metal and thus also functions as a heat radiating section that radiates heat generated in the exposure unit 9 or the control board 25A to an atmosphere. Thus, when observed from the developer chamber 7B, it seems as if heat were generated also from the first connecting member 21A.

Taking the above in mind, in the present embodiment, the developer chamber 7B (process unit 6) is positioned away from the control board 25A, the first connecting member 21A, and the fixing unit 13 in the imaginary horizontal plane so as to avoid overlapping relationship in vertical direction.

Therefore, direct hot air exposure against the developer chamber 7B can be prevented, because most of the hot air released from the fixing unit 13, the exposure unit 9, and the first connecting member 21A is moved upward in the vertical direction without being impinged on the developer chamber 7B. This can avoid excessive heating to the developer contained in the developer chamber 7B, thereby avoiding degradation of the developer at an early stage.

Further, as described above, when viewing in the imaginary vertical plane perpendicular to the extending direction of the first connecting member 21A, the developer chamber 7B is positioned lower than the upper end 9A of the exposure unit 9 and the upper end 13A of the fixing unit 13 as shown in FIG. 1.

Since hot air flows upward, hot air does not reach the developer chamber 7B positioned lower than the upper end 9A of the exposure unit 9 and the upper end 13A of the fixing unit 13.

Therefore, direct hot air application to the developer chamber 7B can be prevented, so that excessive heating to the developer in the developer chamber 7B can be avoided, thereby restraining early degradation of the developer.

(Second Embodiment)

Figure 3:
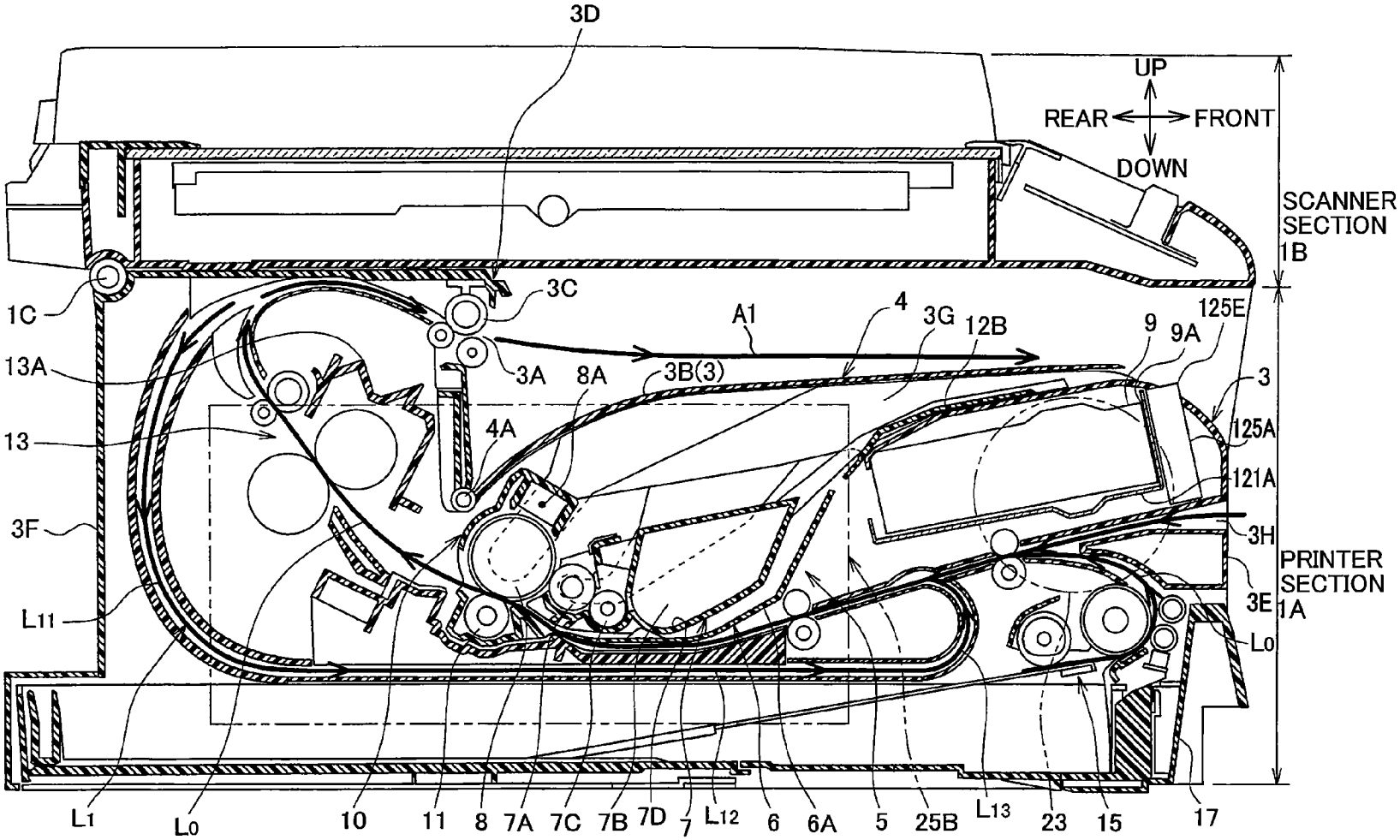
FIG. 3 is a central cross-sectional view of an image forming apparatus according to a second embodiment.

An image forming apparatus according to a second embodiment will next be described with reference to FIGS. 3 and 4 wherein like parts and components are designated by the same reference numerals as those shown in FIGS. 1 and 2. As shown in FIG. 3, in the second embodiment, a control board 125A is positioned opposite to the photosensitive drum 8 (process unit 6) with respect to the exposure unit 9. That is, the control board 125A is disposed at a front end portion of a first connecting member 121A, the front end portion being frontward of the exposure unit 9.

Figure 4:
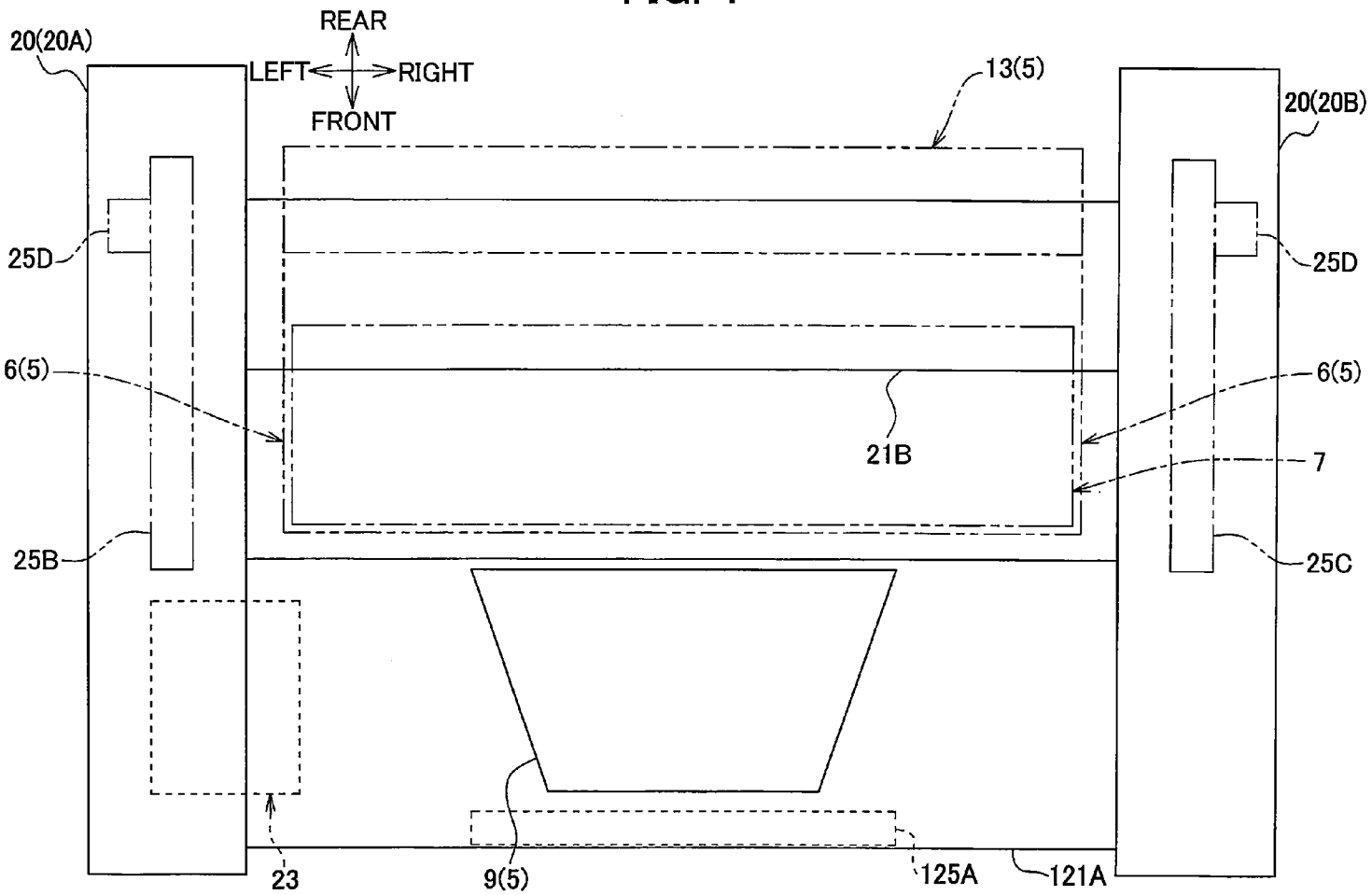
FIG. 4 shows an imaginary horizontal plane, on which a pair of frames, an image forming unit, a first connecting member, and other members in the image forming apparatus according to the second embodiment are projected.

Further, as shown in FIG. 4, at least a part of the control board 125A is superposed with the exposure unit 9 when viewed in an imaginary vertical plane extending perpendicular to the sheet discharging direction A1.

Thus, in the second embodiment, the control board 125A can be positioned remote from components, such as the charger 8A and the transfer unit 11 those being driven by high voltage, and accordingly, the control board 125A can be protected against electrical noise.

As shown in FIG. 3, the control board 125A does not extend in a direction parallel to a substantially horizontal portion of the first connecting member 121A, but extends in substantially vertical orientation. Further, the developer chamber 7B is positioned lower than an upper end 125E of the control board 125A when viewed in the imaginary vertical plane perpendicular to the sheet discharging direction A1.

Incidentally, a lateral position of the control board 125A is not limited to the position shown in FIG. 4 as long as the control board 125A is disposed forward of the exposure unit 9. For example, the control board 125A can be positioned on an end portion of the first connecting member 121A in its longitudinal direction.

(Third Embodiment)

Figure 5:
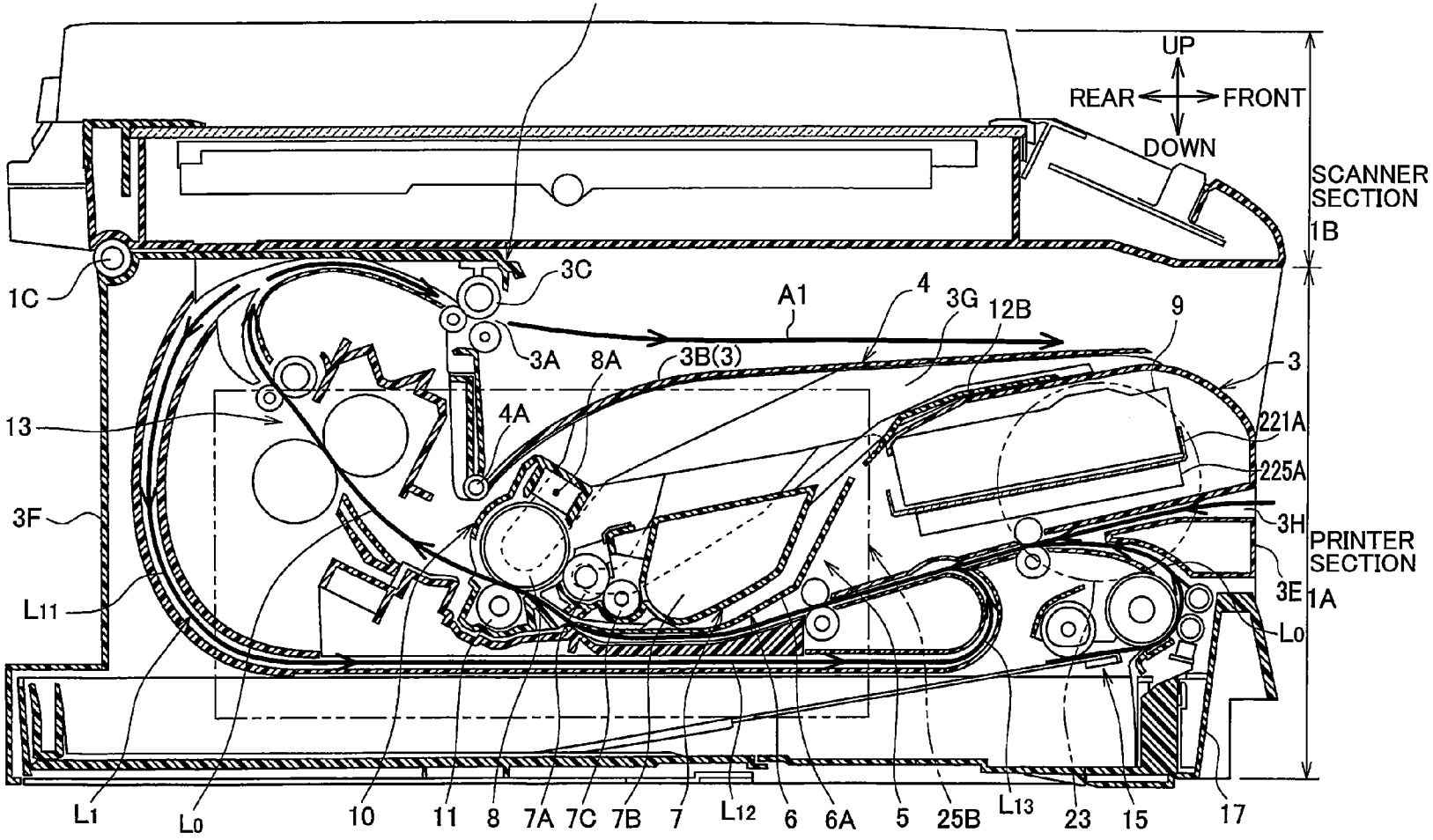
FIG. 5 is a central cross-sectional view of an image forming apparatus according to a third embodiment.
Figure 6:
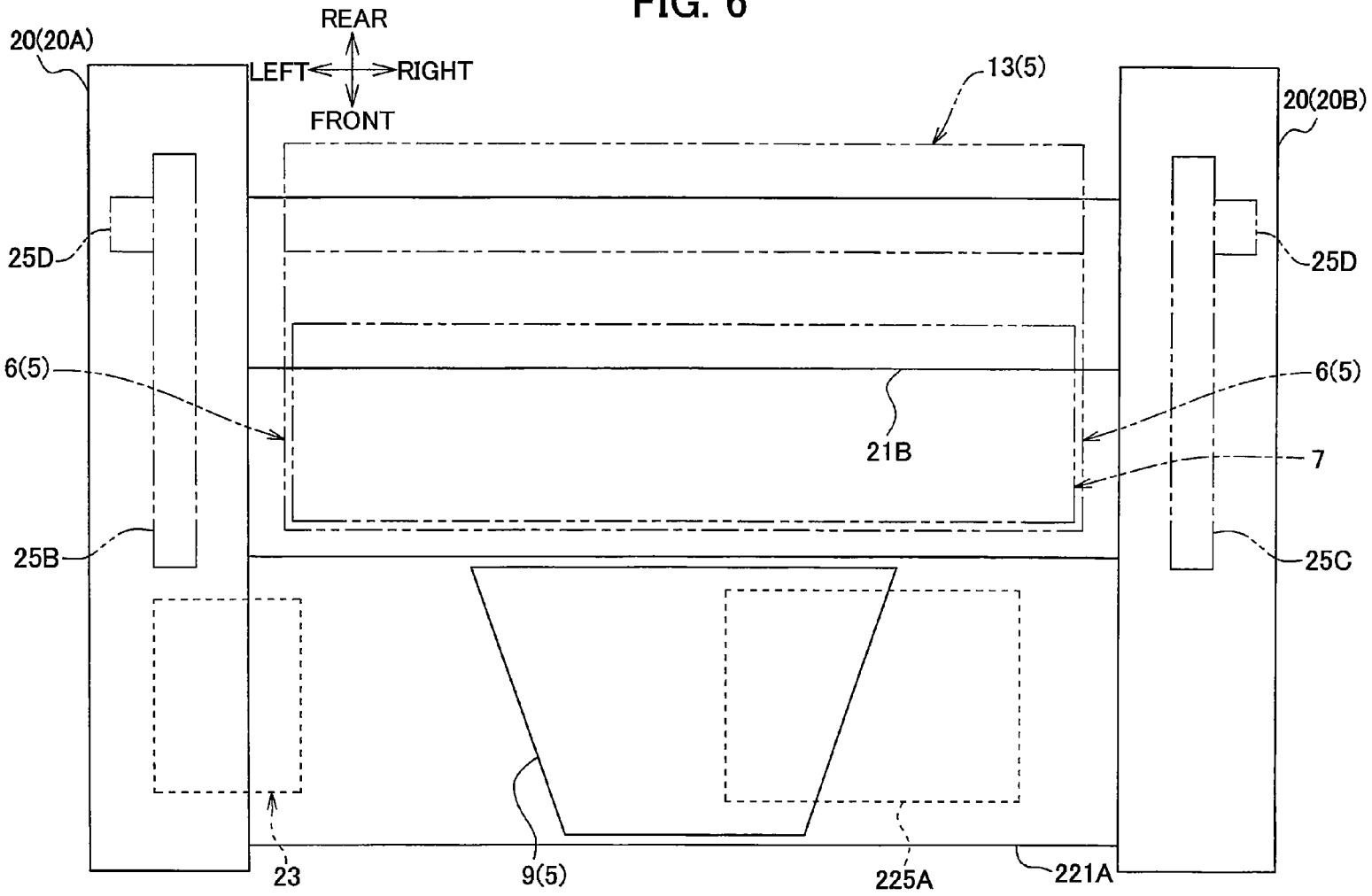
FIG. 6 shows an imaginary horizontal plane, on which a pair of frames, an image forming unit, a first connecting member, and other members in the image forming apparatus according to the third embodiment are projected.

An image forming apparatus according to a third embodiment is shown in FIGS. 5 and 6. As shown in FIG. 5, in the third embodiment, a control board 225A is positioned opposite to the exposure unit 9 in the vertical direction with respect to a first connecting member 221A. Further, as shown in FIG. 6, the control board 225A and the exposure unit 9 are partially overlapped with each other when viewed in an imaginary horizontal plane.

Since the first connecting member 221A exists between the exposure unit 9 and the control board 225A, an elongated electric insulating distance or creepage distance between the exposure unit 9 and the control board 225A can be provided. Thus, the control board 225A can be protected against electrical noise.

Further, the first connecting member 221A can function as a magnetic shield, since the first connecting member 221A provided between the exposure unit 9 and the control board 225A is formed of a metal. Accordingly, enhanced protection of the control board 225A against electrical noise can be obtained.

In the third embodiment, the exposure unit 9 is positioned above the first connecting member 221A, whereas the control board 225A is positioned below the first connecting member 221A. However, as a modification, the exposure unit 9 can be positioned below the first connecting member 221A, and the control board 225A can be positioned above the first connecting member 221A.

(Fourth Embodiment)

Figure 7:
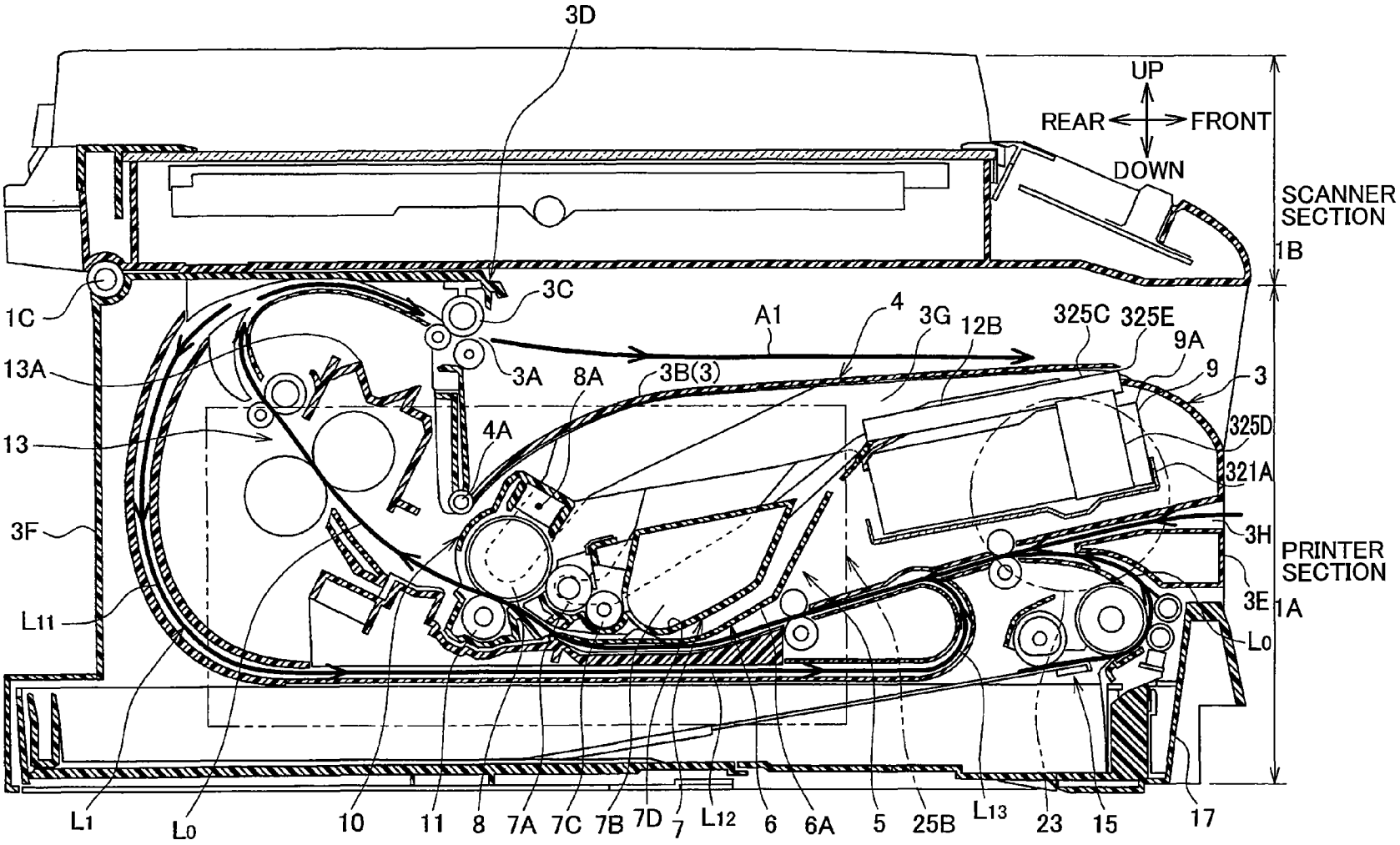
FIG. 7 is a central cross-sectional view of an image forming apparatus according to a fourth embodiment.
Figure 8:
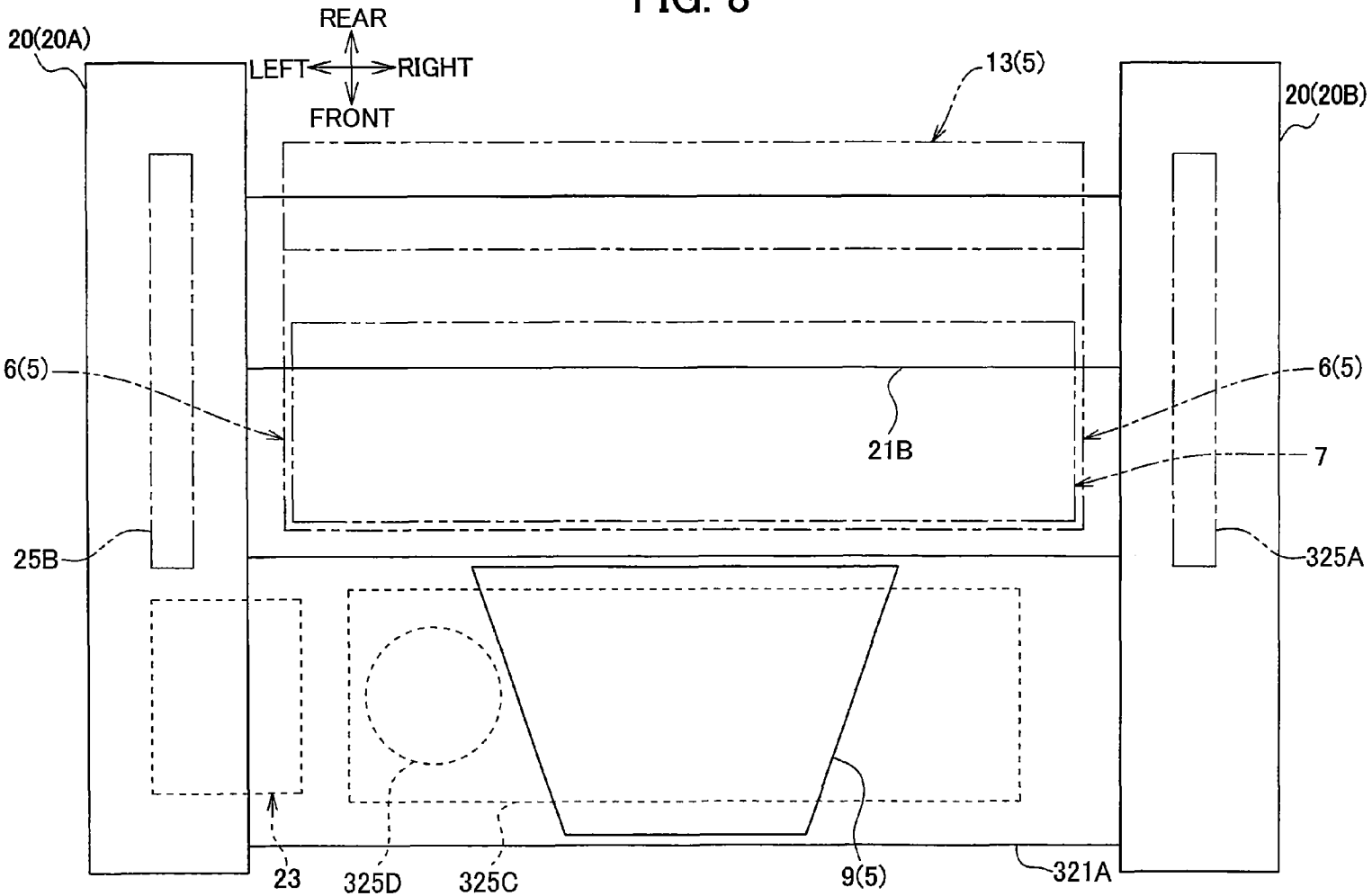
FIG. 8 shows an imaginary horizontal plane, on which a pair of frames, an image forming unit, a first connecting member, and other members in the image forming apparatus according to the fourth embodiment are projected.

An image forming apparatus according to a fourth embodiment is shown in FIGS. 7 and 8. In the fourth embodiment, a low-voltage power supply board 325C is held directly or indirectly by a connecting member 321A. The expression "held directly or indirectly" has the same implication as that described in the first embodiment.

As shown in FIG. 7, the low-voltage power supply board 325C is fixed to the exposure unit 9 which is held by the first connecting member 321A. Thus, the low-voltage power supply board 325C is positioned opposite to the first connecting member 321A with respect to the exposure unit 9 in the vertical direction.

More specifically, the exposure unit 9 is positioned above the first connecting member 321A, and the low-voltage power supply board 325C is positioned above the exposure unit 9. Further, an electrolytic capacitor 325D is positioned on a side of the low-voltage power supply board 325C, the side being facing the first connecting member 321A. Further, the electrolytic capacitor 325D is positioned above the first connecting member 321A.

As shown in FIG. 8, at least a part of the electrolytic capacitor 325D is superposed with the exposure unit 9 when viewed in an imaginary vertical plane perpendicular to the longitudinal direction of the first connecting member 321A. Further, as shown in FIG. 8, the electrolytic capacitor 325D is displaced from the exposure unit 9 when viewed in an imaginary horizontal plane.

Further, at least a part of the low-voltage power supply board 325C is superposed with the exposure unit 9 when viewed in the imaginary horizontal plane. Further, a control board 325A is assembled to the frame 20B of the pair of frames 20.

(Other Embodiments)

According to the above embodiments, the sheet conveying path Lo forms an S-shape. However, this structure or configuration is not limited to this embodiment.

According to the above embodiment, the movable cover 4 forms a part of the sheet discharge tray 3B. However, this structure or configuration is not limited to the embodiment.

Further, according to the above embodiment, the scanner section 1B is provided vertically upward of the printer section 1A. However, this structure or configuration is not limited to the embodiment. The image forming apparatus 1 may be configured without scanner section 1B.

While the image forming apparatus has been described in detail with reference to the embodiments thereof, it would be apparent to those skilled in the art that various changes and modifications may be made therein without departing from the spirit of the above described embodiments. Combination of two or more of the first to forth embodiments may be acceptable.

What is claimed is:

1. An image forming apparatus comprising:

an image forming unit comprising a photosensitive body configured to carry developer, and an exposure unit configured to scan and expose the photosensitive body to light;

a pair of frames disposed in a horizontal direction opposite to each other with the image forming unit being positioned therebetween;

a supply board configured to supply electric power to an electric motor;

a control board configured to control operation of the image forming unit; and a connecting member extending in the horizontal direction and supporting the exposure unit and at least one of the control board and the supply board, the connecting member having each longitudinal end portion connected to each of the pair of frames.

2. The image forming apparatus according to claim 1, wherein the control board is supported to the connecting member, the control board having a part positioned offset from the exposure unit when viewed in a vertical direction.

3. The image forming apparatus according to claim 2, wherein the control board is disposed opposite to the photosensitive body with respect to the exposure unit.

4. The image forming apparatus according to claim 1, wherein the control board is supported to the connecting member, the control board and the exposure unit each having a part overlapped with each other when viewed in a vertical direction.

5. The image forming apparatus according to claim 4, wherein the control board is disposed opposite to the exposure unit with respect to the connecting member in the vertical direction.

6. The image forming apparatus according to claim 1, wherein the supply board is supported to the connecting member and is positioned in superposed relation to the exposure unit in a vertical direction.

7. The image forming apparatus according to claim 6, further comprising an electrolytic capacitor surface-mounted on the supply board and positioned offset from the exposure unit when viewed in the vertical direction.

8. The image forming apparatus according to claim 7, wherein the electrolytic capacitor has a part overlapped with the exposure unit when viewed in an imaginary vertical plane extending in a longitudinal direction of the connecting member.

9. The image forming apparatus according to claim 7, wherein the connecting member is plate shaped; and wherein the electrolytic capacitor is positioned above the connecting member.

10. The image forming apparatus according to claim 1, wherein the supply board is fixed to the exposure unit that is supported to the connecting member.

11. The image forming apparatus according to claim 1, further comprising a sheet discharge tray configured to receive a sheet that has been running in a discharging direction and on which an image has been formed, the exposure unit being positioned forward of the photosensitive body in the discharging direction.

12. An image forming apparatus according to claim 11, further comprising a sheet supply tray disposed lower than the photosensitive body and configured to accommodate sheets which will be conveyed to the photosensitive body; and a sheet conveying path extending from the sheet supply tray to the sheet discharge tray, the sheet conveying path defining a sheet conveying direction;

wherein the sheet discharge tray is disposed higher than the photosensitive body; and wherein the sheet conveying path forms an S-shape when viewed in an imaginary vertical plane extending in a direction perpendicular to a longitudinal direction of the connecting member, the S-shape having a first bending portion at a position below the exposure unit and a second bending portion at a position downstream of the photosensitive body in the sheet conveying direction.

13. The image forming apparatus according to claim 11, further comprising a reconveying path configured to reconvey a sheet, whose one surface has been formed with an image, to the image forming unit, the reconveying path having a part positioned below the exposure unit.

14. The image forming apparatus according to claim 1, wherein each longitudinal end portion of the connecting member is one longitudinal end portion and another longitudinal end portion, the control board being supported to the one longitudinal end portion, and the electric motor being disposed at the another longitudinal end portion.

15. The image forming apparatus according to claim 1, wherein the image forming unit further comprises a developer chamber configured to accommodate developer to be supplied to the photosensitive body, and a fixing unit configured to heat a sheet on which an image has been transferred;

wherein the exposure unit, the developer chamber, and the fixing unit are disposed away from each other when viewed in a vertical direction; and wherein the exposure unit has an upper end and the fixing unit has an upper end, the developer chamber being positioned lower than each of the upper ends when viewed in an imaginary vertical plane extending in a direction perpendicular to a longitudinal direction of the connecting member.

16. The image forming apparatus according to claim 1, wherein the image forming unit further comprises a developer chamber configured to accommodate developer to be supplied to the photosensitive body, and a fixing unit configured to heat a sheet on which an image has been transferred, the developer chamber, the fixing unit, and at least one of the control board and the supply board being disposed away from each other when viewed in a vertical direction.

17. The image forming apparatus according to claim 1, wherein the image forming unit further comprises a developer chamber configured to accommodate developer to be supplied to the photosensitive body, and a fixing unit configured to heat a sheet on which an image has been transferred, the connecting member, the developer chamber, and the fixing unit being disposed away from each other when viewed in the vertical direction.

* * * * *